US010640937B2

(12) United States Patent
Cooper

(10) Patent No.: US 10,640,937 B2
(45) Date of Patent: May 5, 2020

(54) SYSTEM AND METHOD FOR SLIP FORMING CONCRETE BARRIERS

(71) Applicant: Howard Cooper, Corona, CA (US)

(72) Inventor: Howard Cooper, Corona, CA (US)

( * ) Notice: Subject to any disclaimer, the term of this patent is extended or adjusted under 35 U.S.C. 154(b) by 80 days.

(21) Appl. No.: 15/870,537

(22) Filed: Jan. 12, 2018

(65) Prior Publication Data

US 2018/0334780 A1 Nov. 22, 2018

Related U.S. Application Data

(62) Division of application No. 14/555,094, filed on Nov. 26, 2014, now Pat. No. 9,869,066.

(60) Provisional application No. 61/909,947, filed on Nov. 27, 2013.

(51) Int. Cl.
*E01F 15/08* (2006.01)
*E01C 19/48* (2006.01)

(52) U.S. Cl.
CPC ..... *E01F 15/083* (2013.01); *E01C 19/4886* (2013.01)

(58) Field of Classification Search
CPC ..... E01F 19/4886; E01F 15/08; E01F 15/083
See application file for complete search history.

(56) References Cited

U.S. PATENT DOCUMENTS

| | | | |
|---|---|---|---|
| 857,587 | A | 6/1907 | Boyle |
| 945,312 | A | 1/1910 | Firth |
| 3,200,177 | A | 8/1965 | Dodd |
| 3,530,552 | A | 9/1970 | Calder |
| 3,600,773 | A | 8/1971 | Davis et al. |
| 3,832,079 | A | 8/1974 | Moorhead |
| 3,898,778 | A | 8/1975 | Erickson et al. |
| 4,073,592 | A | 2/1978 | Godberson et al. |
| 4,084,928 | A | 4/1978 | Petersik |
| 4,211,743 | A | 7/1980 | Nauta et al. |
| 4,490,067 | A | 12/1984 | Dahowski |
| 4,512,121 | A | 4/1985 | Carydias et al. |
| 4,526,493 | A | 7/1985 | Hall et al. |
| 4,533,111 | A | 8/1985 | Cousin et al. |
| 4,553,875 | A | 11/1985 | Casey |
| 4,872,823 | A | 10/1989 | Howard |
| 5,033,906 | A | 7/1991 | Jordan |
| 5,173,309 | A | 12/1992 | Belarde |
| 5,292,467 | A | 3/1994 | Mandish et al. |
| 5,290,492 | A | 5/1994 | Belarde |

(Continued)

FOREIGN PATENT DOCUMENTS

| | | | |
|---|---|---|---|
| FR | 2684399 | A1 | 6/1993 |
| GB | 2231904 | A | 11/1990 |

OTHER PUBLICATIONS

Green, Jonathan, Technical Guidance Sheet S3-Slip-formed Slot Drain, Sep. 2001, Britpave, 1-2, http://www.britpave.org.uk/uploads/documents/originals/tgs_s3.pdf.

(Continued)

*Primary Examiner* — James Sanders
(74) *Attorney, Agent, or Firm* — Knobbe, Martens, Olson & Bear, LLP

(57) ABSTRACT

Systems and methods for the continuous slip form construction of concrete barriers over support cages. A tube feeder of a slip form construction system can include angled tubes that can direct reinforcing bars into a concrete barrier and also provide space between the tubes for insertion of a support cage through the system and into the concrete barrier.

14 Claims, 12 Drawing Sheets

(56) References Cited

U.S. PATENT DOCUMENTS

| | | | |
|---|---|---|---|
| 5,421,670 | A | 6/1995 | Meirick |
| 5,533,888 | A | 7/1996 | Belarde |
| 5,616,291 | A | 4/1997 | Belarde |
| 5,735,634 | A | 4/1998 | Ulrich et al. |
| 5,993,108 | A | 11/1999 | Buhman |
| 6,293,728 | B1 | 9/2001 | Eggleton et al. |
| 6,394,410 | B1 | 5/2002 | Thompson |
| 6,540,435 | B1 | 4/2003 | Lizarraga |
| 6,709,195 | B2 | 3/2004 | Piccoli et al. |
| 6,817,849 | B1 | 11/2004 | Taylor |
| 6,923,630 | B2 | 8/2005 | Allen |
| 7,264,418 | B1 | 9/2007 | Houck |
| 7,357,861 | B2 | 4/2008 | Kelley et al. |
| 8,342,773 | B2 | 1/2013 | Kropacek |
| 9,797,099 | B2 | 10/2017 | Engels et al. |
| 9,869,066 | B2 | 1/2018 | Cooper |
| 2011/0227241 | A1 | 9/2011 | Nave et al. |
| 2016/0340840 | A1 | 11/2016 | Yun |
| 2018/0334780 | A1 | 11/2018 | Cooper |

OTHER PUBLICATIONS

Summary of Federal Highway Administration's Drainage Efforts—Pavements—FHWA, 4 pages, Feb. 5, 2002, www.fhwa.dot.gov/Pavement/drain.cfm.

Gaine CF pamphlet, Interface Développement, believed to be published around Nov. 2006.

Abstract, Drainage Evaluation at the U.S. 50 Joint Sealant Experiment, J. Transp. Engineering, vol. 13, Issue 8, 2007, viewed at http://dx.doi.org/10.1061/(ASCE)0733-947X(2007)133:8(480).

Miller Formless, M-1000 Curb & Gutter Machine, 2 pages, retrieved Nov. 6, 2009, www.millerformless.com/m1000specs.html.

PRIOR ART

SYSTEM AND METHOD FOR SLIP FORMING CONCRETE BARRIERS

PRIORITY CLAIM

This application is a divisional of U.S. patent application Ser. No. 14/555,094, filed Nov. 26, 2014, entitled SYSTEM AND METHOD FOR SLIP FORMING CONCRETE BARRIERS, which claims the benefit of U.S. Provisional Appl. No. 61/909,947, filed Nov. 27, 2013, entitled SYSTEM AND METHOD FOR SLIP FORMING CONCRETE BARRIERS, the entire disclosure of each is hereby incorporated by reference.

BACKGROUND OF THE DISCLOSURE

Field of the Disclosure

The present disclosure relates generally to slip-form construction involving wet concrete and to slip-form construction of barriers and other longitudinally extending concrete constructs.

Description of the Related Art

Slip-form construction is a method of building involving wet concrete. The name refers to the moving form or mold the concrete is poured into, which moves along the project as the previously poured concrete hardens behind it. Slip-form relies on the quick-setting properties of concrete requiring a balance between early strength gain and workability. The technique has been applied to large buildings and to road construction.

Slip-form construction is frequently used for building barriers along an extended length, such as barriers provided along the length of the median of a road to prevent vehicles from crossing over and into oncoming traffic. Many varieties of slip-form systems exist for constructing such barriers. However, such devices and certain components thereof have various limitations and disadvantages.

SUMMARY OF THE DISCLOSURE

The slip form construction of barriers, such as dividers along the median of a highway, generally involves the use of a system that includes a hopper configured to receive concrete and a mold connected to the hopper and into which concrete passes from the hopper. As the system advances down the roadway, concrete that passes from the hopper into the mold is formed into a desired barrier shape and exits the mold in the form of the desired barrier, at which point it is allowed to cure and/or harden. In order to provide stability and strength to the barrier, reinforcement rods or bars (e.g., rebar) are typically inserted into the barrier and extend along the length of the barrier. Generally, the number and location of reinforcement bars are dictated by the particular specifications of a construction project, such as the specifications provided by a state or federal government or agency. Generally, in order to provide the reinforcing bars at the required locations, a tube feeder can be at the face of the hopper or at least partially inserted into the hopper. The tube feeder can be configured to receive lengths of reinforcing bars from a position in front of the hopper, and can direct the bars into the concrete in the hopper from where they pass into the mold and into the finished barrier.

Generally, the specifications of a particular project require additional support in certain locations. For example, in some projects, a cage formed of reinforcing bar can be required to be inserted within a length of the barrier. Frequently, the inclusion of cages can be required at anchor locations (e.g., where a cage can be inserted into an anchor footing dug into the ground), when constructing split level walls or barriers (e.g., to help secure a first-formed bottom level to a second-formed top level), and/or in walls or barriers of varying types. Generally, the longitudinal bars of a cage are configured to be positioned at approximately the same location within a barrier as are the reinforcing bars in sections that do not include a cage. Thus, in traditional slip form systems, the cages cannot fit past the tube feeder, into the hopper, and into the molds so that they can be positioned within the finished barrier. This is because tubes of a tube feeder, which are each positioned and configured to receive a single rod, interfere with and block the insertion of an entire cage past the tube feeder and into the hopper.

Thus, where a cage was required to be inserted within a barrier made with a traditional system, there were two options: (1) the slip form system would need to stop, be moved past the cage, and concrete would need to be placed by hand around the cage, or (2) one or more of the sections of the tube feeder would need to be removed to allow the cage to fit into the hopper. Both of these options required significant delays in the process of slip forming the barrier. For example, forming the section around the cage by hand can take a significant amount of time and moving the slip form system from its established track around a cage can also take time. Forming the section around the cage by hand means that the barrier is not monolithically formed through the cage, which can diminish the strength of the barrier. Further, this procedure ends up wasting concrete because when the slip form system stops forming concrete to be moved around the barrier, the final amount of concrete to pass through the system cannot be used. And the alternate option, removing one or more of the sections of the tube feeder, can be very difficult because of the concrete that may have accumulated and partially dried on and around the tube feeder. It takes time to stop the process to remove the section of the tube feeder. Removing the sections also requires cutting the reinforcing bars being fed into the tubes in order to allow for removal of the sections.

Various embodiments described herein are configured to allow for the continuous slip form construction of concrete barriers from sections that include individual, longitudinal reinforcing bars past sections that include cages formed of reinforcing bars. Embodiments described herein can also be used for the continuous slip form construction past other types of inserts or supports to be positioned within a concrete barrier, in addition to or instead of cages formed of reinforcing bars. In various embodiments described herein, slip form systems can be configured to include tube feeders with tubes that can receive individual reinforcing bars and can direct those reinforcing bars into a required position within a slip formed concrete barrier, but that do not impede the insertion of a reinforcing cage or other insert through the tube feeder and into the hopper, from where the cage or other insert can pass into the mold such that it is positioned as required within the completed concrete barrier.

In various embodiments, a system for the slip-form construction of a concrete barrier can include a mold having a front end and a back end connected by a central axis, the mold configured to receive concrete at the front end and shape the concrete into the form of a molded concrete barrier to exit the mold at the back end. The system can also include a hopper connected to the mold, the hopper having a front end and a back end connected by the central axis, the hopper configured to receive concrete and provide concrete to the mold. The system can also include a tube feeder having a frame defining a longitudinal opening and a plurality of tubes passing through the frame, each tube configured to receive a reinforcing bar at a front end of the tube and to direct the reinforcing bar out of the tube at a back end of the tube and into the hopper to thereby extend through the hopper and mold and into the molded concrete barrier. The plurality of tubes can include at least a first pair of tubes positioned at approximately the same height from a bottom of the tube feeder, and the tubes of the first pair of tubes can be angled relative to the central axis such that the shortest distance between the two tubes is greater at the front of the tube feeder than the back of the tube feeder.

In various embodiments, a system for the slip-form construction of a concrete barrier can include a mold having a front end and a back end connected by a central axis, the mold configured to receive concrete at the front end and shape the concrete into the form of a molded concrete barrier to exit the mold at the back end. The system can also include a hopper connected to the mold, the hopper having a front end and a back end connected by the central axis, the hopper configured to receive concrete and provide concrete to the mold. The system can also include a tube feeder having a frame defining a longitudinal opening and a plurality of tubes passing through the frame, each tube configured to receive a reinforcing bar at a front end of the tube and to direct the reinforcing bar out of the tube at a back end of the tube and into the hopper to thereby extend through the hopper and mold and into the molded concrete barrier. The plurality of tubes can include at least a first pair of tubes positioned at approximately the same height from a bottom of the tube feeder, and the reinforcing bars passing through the tubes of the first pair of tubes are configured to be a first defined distance apart when the reinforcing bars are within the molded concrete barrier. In some embodiments, the width of the longitudinal opening at the height of the first pair of tubes is at least as wide as the first defined distance that the reinforcing bars passing through the first pair of tubes are apart when the reinforcing bars are within the molded concrete barrier.

In various embodiments, a method for the slip-form construction of a continuous concrete structure over a reinforcement structure can include providing a slip-form molding system that has a hopper, a mold, and a tube feeder configured to direct reinforcing bars through the hopper and mold and into a concrete structure formed by the mold. The tube feeder can include a first pair of tubes and an opening between the tubes, the tubes positioned at approximately the same height above a bottom of the tube feeder and angled relative to each other such that the tubes are closer to each other at the back of the tube feeder than at the front of the tube feeder. The opening can extend from the bottom of the tube feeder to the first pair of tubes. The method can also include advancing the slip-form molding system over a support insert such that the support insert passes through the tube feeder, through the hopper, and through the mold into a position within the concrete structure.

In various embodiments, a method for the slip-form construction of a continuous concrete structure over a reinforcement structure can include providing a slip-form molding system that has a hopper, a mold, and a tube feeder configured to direct reinforcing bars through the hopper and mold and into a concrete structure formed by the mold such that the concrete structure includes at least one pair of reinforcing bars on a single horizontal plane. The tube feeder can have an opening from the bottom of the tube feeder to a height at least as tall as the highest of the at least one pair of reinforcing bars on a horizontal plane. The method can also include advancing the slip-form molding system over a support insert at least as tall as the highest of the at least one pair of reinforcing bars on a horizontal plane, such that the support insert passes through the tube feeder, through the hopper, and through the mold into a position within the concrete structure.

DETAILED DESCRIPTION

With reference to the attached figures, certain embodiments and examples of systems and methods for slip forming of concrete barriers are described. Various aspects of the description will reference callouts with one or more primes, such as a tube "60'." This designation is intended to be used to identify a particular one of many tubes 60. It is not meant to indicate a difference between elements of a like number beyond those described. Similarly, it is not meant to exclude an element, such as tube "60'''" from descriptions pertaining generally to tubes 60.

Figure 1:
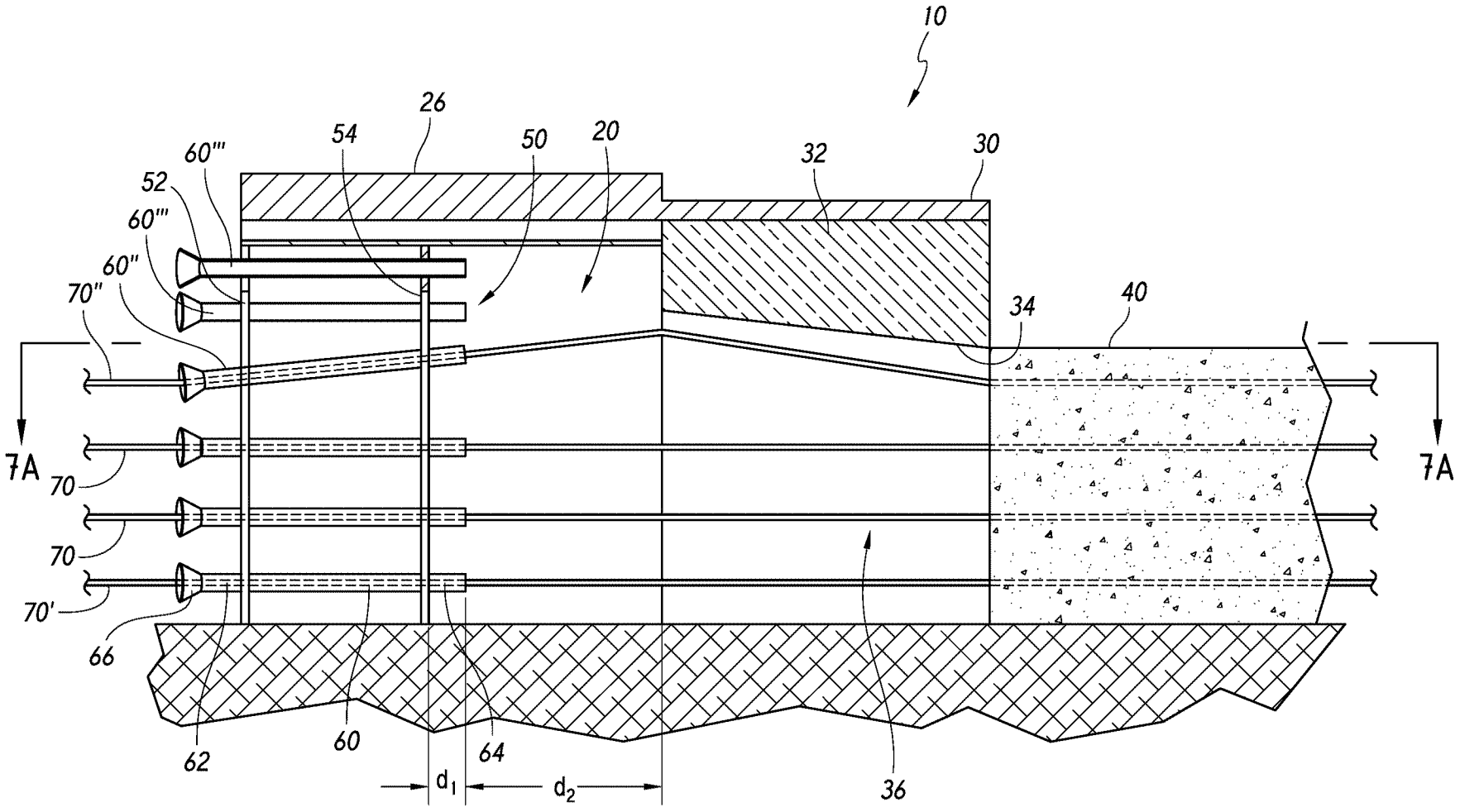
FIG. 1 is a side cross-sectional view of one embodiment of a slip form construction system.

FIG. 1 illustrates one embodiment of a slip form concrete molding system 10. The system can include a hopper 20 that is configured to receive concrete. Preferably the hopper receives concrete from an opening on the top of the hopper, such as through the top 26, although in some embodiments it can receive concrete from a side or other location. The hopper 20 can pass the concrete into a mold 30, which can form the concrete into a desired shape, such as the barrier 40. The formed concrete can then pass out the back of the mold where it can dry and harden in the desired shape. In some embodiments, the hopper and mold can be formed of unitary walls, as illustrated. In some embodiments, the hopper and mold can be separate, modular pieces that can be joined together, such as through welding, bolting, or other suitable methods. This can allow for the exchange of molds of varying shapes and designs with the hopper.

In various embodiments, a mold 30 can include modular components such that it is possible to form barriers of different sizes and shapes depending on the particular configuration of modular components in the mold or their removal from the mold. For example, in some embodiments, a mold can include an insert 32 that can be configured to limit the height of a slip formed barrier 40. The insert can fill in a portion of the molding area 36, making it smaller to thereby produce a smaller slip formed concrete barrier. In some embodiments, as illustrated, a bottom wall 34 of an insert 32 (or a top wall of the mold) can be angled downward from the front of the mold to the back of the mold. This can help increase the pressure on the concrete as it passes through the mold, which can help provide a more compact barrier with smoother surfaces.

In some embodiments, one or more reinforcing bars or rods 70 can be fed into the hopper to pass through the mold and into a position within the concrete barrier 40. In some embodiments, the lateral and/or vertical positioning of the reinforcing bars 70 can be defined by the specifications of a particular project and/or the particular regulations in the jurisdiction where the project takes place.

Generally, in order to help direct the reinforcing bars 70 into the required location, a tube feeder 50 can be positioned adjacent the hopper 20. In some embodiments, a tube feeder can include a front frame 52 and a back frame 54 joined by a plurality of tubes 60, each of which has a front end 62 and a back end 64. In some embodiments, the tubes can pass through just a single frame or more than two frames. In some embodiments, as illustrated, the back end 54 of the tube feeder can form a front wall of the hopper. In some embodiments, the tube feeder and the hopper can be the same piece or can be welded together, bolted together, or otherwise suitably joined.

A tube feeder can generally include multiple levels of tube 60, as illustrated. Each tube can be configured to receive a reinforcing bar 70. For continuous construction, lengths of reinforcing bar can be tied or otherwise secured to each other to ensure a continuous feed of reinforcing bar through each tube. In some embodiments, the tubes can have a flared section 66 at an opening in the front end 62 to help direct reinforcing bars 70 into the tubes. In some embodiments, a tube feeder can include levels of tubes sufficient to feed reinforcing bars 70 to support the highest barrier 40 that can be constructed with the particular slip form system 10 (e.g., when insert 32 has been removed). However, in some embodiments, as illustrated, not all of the tubes need to be used for a particular project. For example, where the mold includes an insert 32 to lower the height of a produced barrier, the uppermost tubes 60''' may not have reinforcing bars 70 passing through them, as illustrated. Where the insert is not included in the mold and/or the mold is configured to mold barriers at the maximum height supported by the mold, more of the tubes 60 can be used to feed reinforcing bars 70 into the hopper 20 and mold 30. In some embodiments, where not all of the tubes are necessary, one or more of the unnecessary tubes can be removed from the tube feeder 50 during construction.

In some embodiments, where the mold 30 includes an angled upper wall 34, it can be desirable to have the top reinforcing bar 70" enter the mold 30 at a vertical position above its final vertical position within the barrier 40. This is because once the reinforcing bar 70" enters the mold, it will generally maintain its vertical position relative to the angled wall 34, as illustrated, moving downward as the angled wall moves downward. In some embodiments, the correct positioning of the top reinforcing bar 70" can be ensured by providing an upward angle of the tube 60" that receives the bar 70". Thus, as illustrated, the tube 60" can direct the reinforcing bar 70" to a desired position when entering the mold 30 such that the reinforcing bar retains a desired position once within the concrete barrier.

In some embodiments, the tubes 60 can be configured to enter into the hopper a particular distance $d_1$. This distance can vary, although it is preferably at least six inches. Inserting the tubes a sufficient distance into the hopper can help ensure that the weight of the concrete on the bars does not push them too far down. Inserting the tubes a distance into the hopper can also help ensure that concrete does not enter the back end 64 of the tubes. In some embodiments, tubes can include valves that allow the bars 70 to pass through, but that help prevent concrete from entering the tubes. For example, rubber or plastic caps with slits formed therein to allow the rods to pass through may be included on the tubes.

Figure 2A:
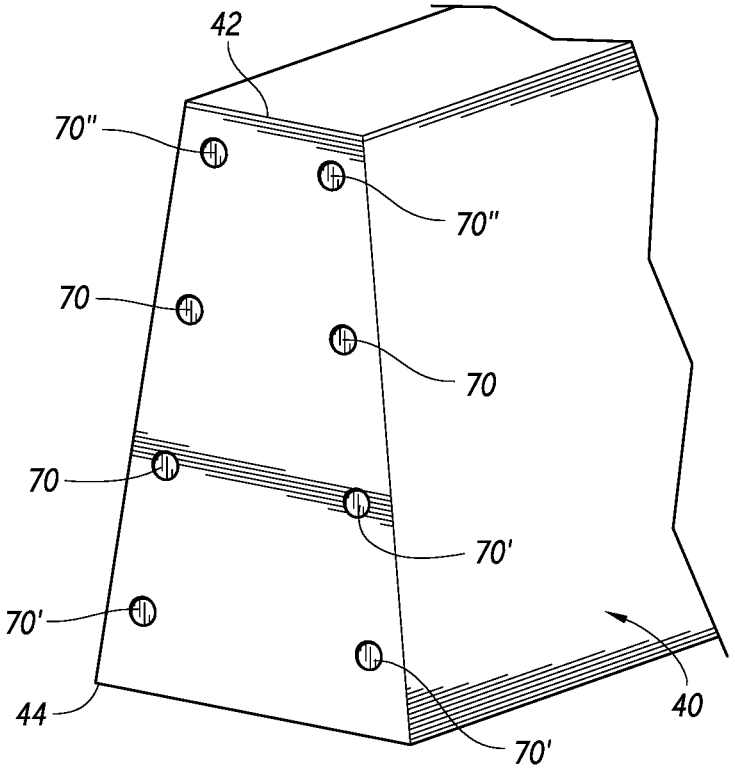
FIG. 2A is a cross-sectional perspective view of one embodiment of a concrete barrier formed by a slip form construction system.
Figure 2B:
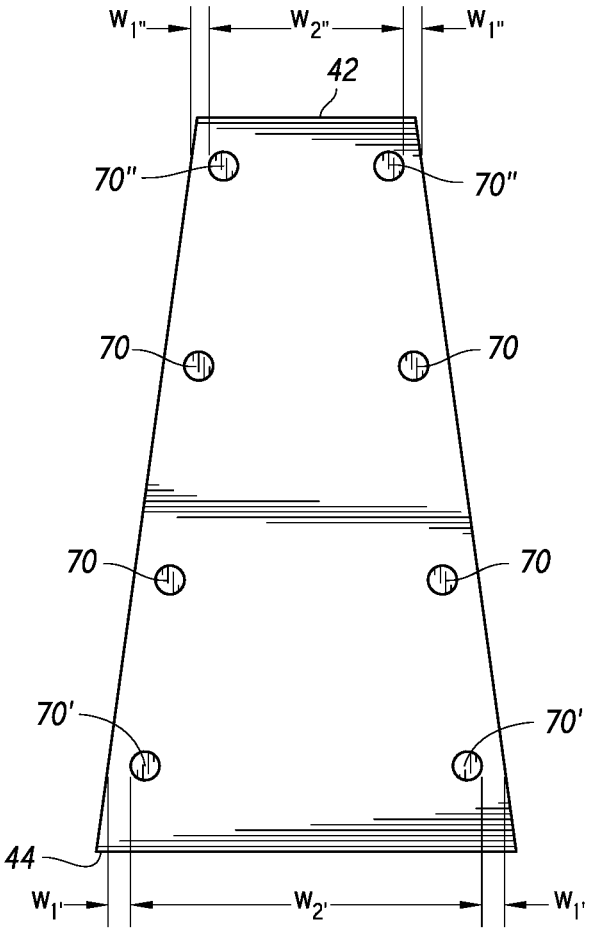
FIG. 2B is a front cross-sectional view of the concrete barrier of FIG. 2A.

FIG. 2A illustrates a perspective cross-sectional view of a slip formed concrete barrier 40 and FIG. 2B illustrates a cross-sectional view of the barrier. Generally, the barrier will have a top wall 42 that is narrower than a bottom wall 44, although other configurations and arrangements are possible. Reinforcing bars 70 can pass through the barrier, as illustrated. Generally, the specifications for a project require that the reinforcing bars be a defined width $w_1$ from an adjacent outer wall of the barrier. The reinforcing bars can be positioned in pairs at varying heights. Thus, for example, a first pair of bars 70', 70' can be positioned at approximately the same first height from the bottom of the barrier. The bars can each be a width $w_{1'}$ from the adjacent outer wall and a width $w_{2'}$ apart from each other at the outer edge of the bars. In some embodiments, as illustrated, the first pair of bars 70', 70' can be the lowest pair of bars. A second pair of bars 70", 70" can be positioned at approximately the same second height from the bottom of the barrier, the second height being greater than the first height. As illustrated, in some embodiments, the second pair of bars can be a distance $w_{1''}$ from the outer walls and a distance $w_{2''}$ apart from each other at their outer edges. In some embodiments, as illustrated, the second pair of bars 70", 70" can be the highest pair of bars. Generally, the distance $w_{1''}$ is the same as the distance $w_{1'}$, such that the narrowing of the barrier causes the distance $w_{2''}$ to be less than $w_{2'}$. Thus, as illustrated, in some embodiments the distances between rods in a pair can diminish for successively higher pairs of rods.

In some embodiments, according to the specifications of a particular project, other relationships may be used. For example, in some embodiments bars of different levels may be positioned varying distances from an outer wall of the barrier. In some embodiments, the distance $w_{1''}$ can be greater than or less than $w_{1'}$. In some embodiments, the distance $w_{2'}$ between a first pair of bars can be approximately equal to the distance $w_{2''}$ between a second pair of bars.

Figure 3A:
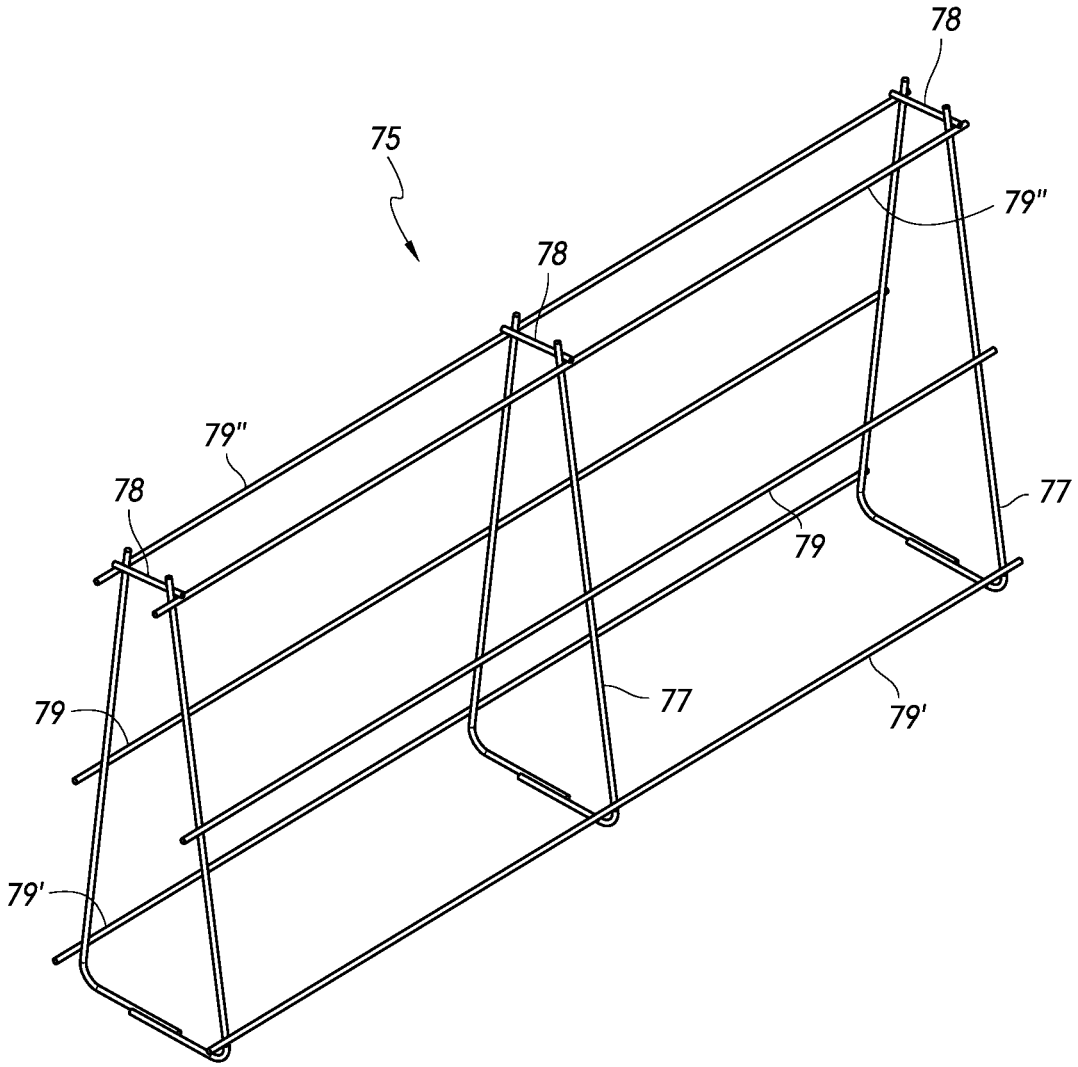
FIG. 3A is a perspective view of one embodiment of a cage that can be positioned within a concrete barrier.
Figure 3B:
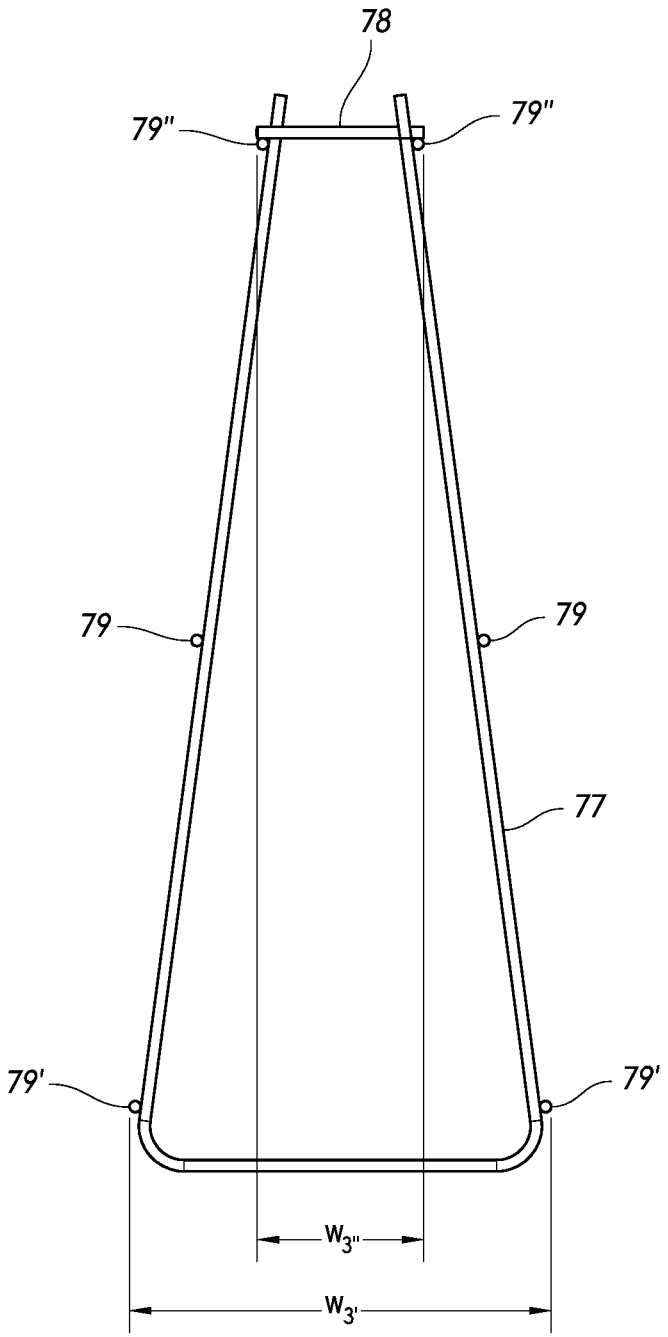
FIG. 3B is a front view of the cage of FIG. 3A.

In some embodiments, in addition to requiring longitudinally extending reinforcing bars, as illustrated, project specifications may require positioning of a cage formed of reinforcing bars within sections of the barrier 40. In some embodiments, other types of support inserts may be required. For example, inserts of vertical reinforcement rods or bars (e.g., rebar) may be included in the design, such as when the barrier passes over drainage, over scuppers, or over or at other structures. FIG. 3A illustrates a perspective view of one such cage 75 and FIG. 3B illustrates a front view. Generally, a cage will include longitudinally extending reinforcing bars 79 and looped or partially looped bars 77 that have a portion extending vertically across the longitudinal bars 79. In some embodiments, the looped bars can be joined by a cross bar 78. The bars can be tied together and/or welded together or otherwise joined to maintain their relative positioning prior to the application of concrete. In some embodiments, as illustrated, a cage can include three vertically supporting looped bars 77. In some embodiments, a cage can include more or fewer. In some embodiments, cages can be made shorter or longer. Other cage constructions are possible.

Generally, the longitudinally extending bars 79 are configured to align with bars 70 in other portions of the barrier, such as the bars illustrated in FIG. 2. This places the longitudinally extending bars 79 of the cage at the same position relative to an outer wall of the barrier, as generally required by the job specification. Similarly, aligning bars 79 and bars 70 places the bars 79 such that the distance between them is generally the same as corresponding bars 70. Thus, for example, with reference to FIG. 3B, in some embodiments a cage can have a bottom pair of bars 79', 79' with a width $w_{3'}$ between the outer edges of both bars. In some embodiments, the width $w_{3'}$ can be approximately equal to the width $w_{2'}$ illustrated in FIG. 2B. Similarly, a cage can have a top pair of bars 79", 79" configured to align with bars 70", 70" of FIG. 2B. The width $w_{3''}$ between the outer sides of the bars 79", 79" can be approximately equal to the width $w_{2''}$ shown in FIG. 2B.

In some embodiments, a cage can have a longitudinally extending bar 79 for every bar 70 in a barrier. In some embodiments, every longitudinally extending bar of the cage can be aligned with a bar extending in the barrier. In some embodiments a cage can have more or fewer bars 79 than are in the barrier.

Figure 4:
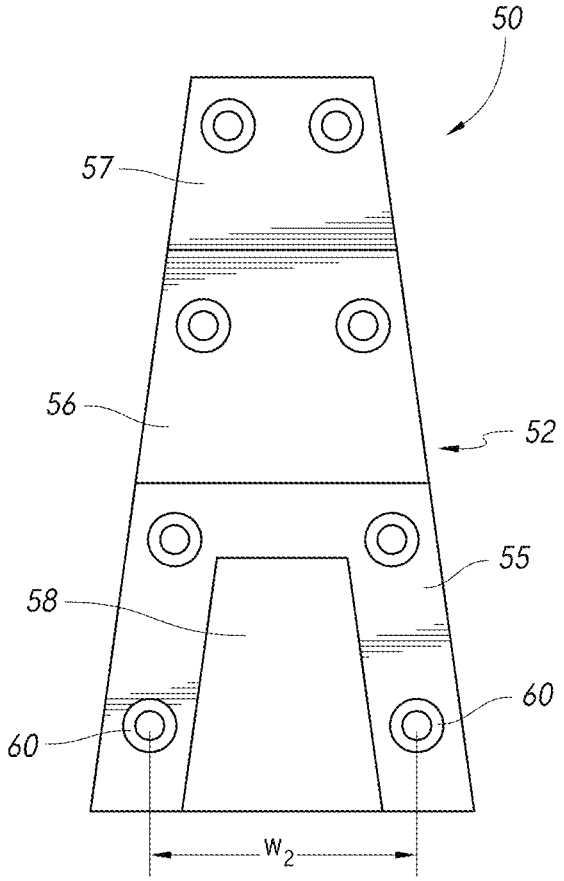
FIG. 4 is a front view of a prior art tube feeder.

As described above, continuously operating a slip form system to both receive bars as illustrated in FIG. 1 and to receive a cage as illustrated in FIG. 3A has traditionally presented difficulties. For example, FIG. 4 illustrates a front view of a prior art tube feeder 50. The front frame 52 of the tube feeder includes separable sections, such as the bottom section 55, the middle section 56, and the top section 57. Each section includes two tubes 60 configured to receive reinforcing bars 70. The tubes 60 extend through the mold with equal lateral spacing $w_2$ along their length. The tube feeder has a feeder opening 58 that is used to pass over small obstacles. Such opening is traditionally kept small so as to maintain a sufficient head pressure on the concrete and to limit the amount of concrete that might pass through the opening forward of the mold. In some instances, shorter objects, such as dowels used for bridge decks, often have required lateral spacing that can cause them to interfere with traditionally placed tube feeders. For example, common specifications call for 10 inch spacing between dowels and such spacing can cause the dowels to run into the tubes or the tube flanges 66 of traditional tube feeders and mold systems. In addition, cages 75 that include longitudinal reinforcing bars configured to align with the reinforcing bars that pass through tubes 60 are not able to fit through the feeder opening 58. The distance between the centers of lateral pairs of tubes 60 would be approximately equal to $w_2$, the distance between lateral pairs of reinforcing bars in the cage. Thus, the cage would not be able to move past the tubes 60. In order to pass a cage through the feeder 50, one or more of the sections 55, 56, 57 would need to be removed, which was a time-consuming and laborious process, as described above.

Figure 5A:
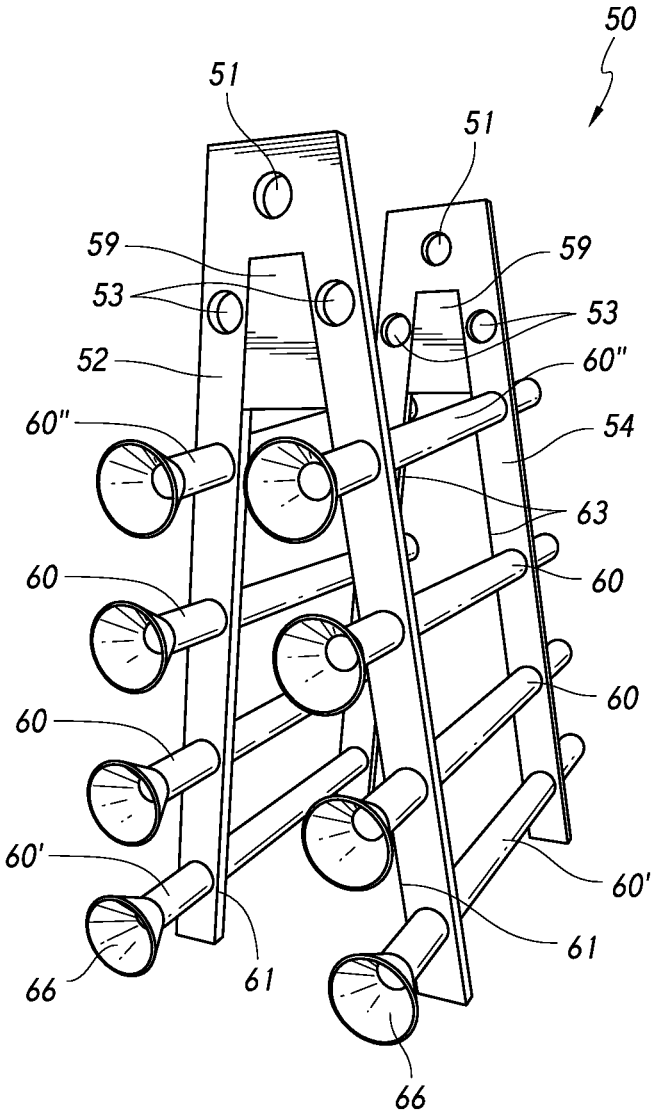
FIG. 5A is a perspective view of one embodiment of a tube feeder.
Figure 5B:
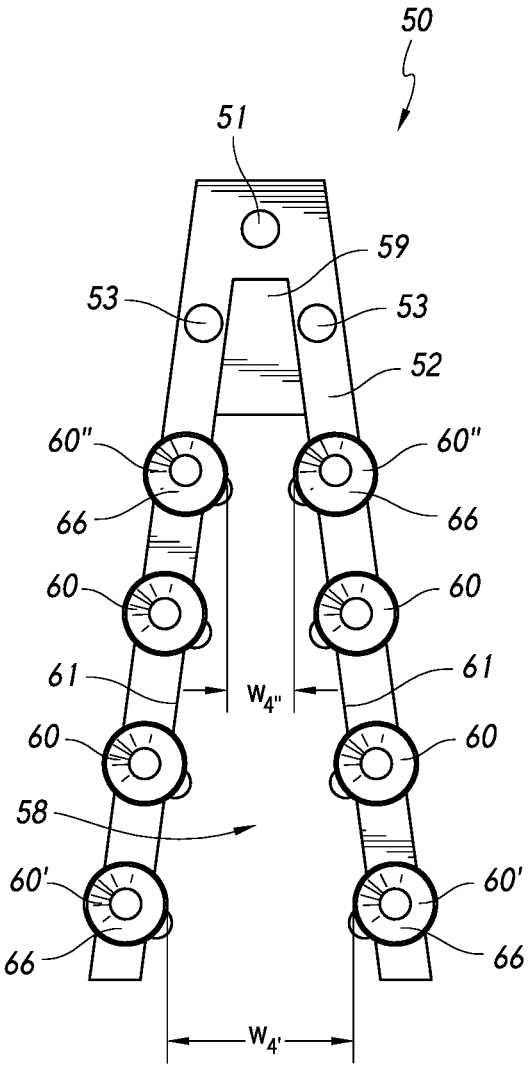
FIG. 5B is a front view of the tube feeder of FIG. 5A.

Various embodiments described herein can be configured to simultaneously allow for feeding of reinforcing bars into the slip form system while also providing the option to pass a slip form system over a cage or other insertions, thereby allowing the continuous production of a barrier that includes reinforcement cages or other insertions. FIGS. 5A and 5B illustrates one embodiment of a tube feeder 50 that can be configured to allow for such continuous slip form construction of a barrier. This can be accomplished by angling the tubes 60 outward (more easily visible in FIG. 7A). Thus, in some embodiments, the narrowest distance in the feeder opening 58 at the front of the tube feeder at a given height, such as between tubes 60 of a pair of tubes, is approximately greater than or equal to the width of a cage at that height. For example, the distance $w_{4'}$ between the bottom pair of tubes 60', 60' can be greater than or equal to the distance $w_{2'}$ between the outer edge of the bottom pair of reinforcing bars 70', 70' in the barrier. Correspondingly, in some embodiments the distance $w_{4'}$ between the bottom pair of tubes 60', 60' can be greater than or equal to the distance $w_{3'}$ between the outer edge of the bottom pair of reinforcing bars 79', 79' in a cage 75.

Pairs of tubes 60 positioned higher from the bottom of the tube feeder can similarly be angled outward to be farther apart than corresponding bars in the barrier or of a cage. For example, in some embodiments the narrowest width $w_{4''}$ at the front of the tubes can be greater than or equal to the width $w_{2''}$ and/or than the width $w_{3''}$. In some embodiments, if the size of the cage is larger, such as by having the longitudinal bars 79 positioned farther apart than bars 70 in the barrier, or by having the looped bars 77 positioned outside of the longitudinal bars, the tubes can be positioned at a greater angle as required to provide space for the cage. Thus, cages will be able to fit into the feeder opening 58, passing into the hopper 20 and the mold 30. Although the distance $w_4$ is illustrated as connecting flared portions 66 of the tubes 60, it is understood that the distance $w_4$ refers to the width of the feeder opening 58 at the indicated height. Thus, for example, in some embodiments where the front of the tubes do not pass inward of the edges 61 of the front frame 52, such as where the tubes do not have flared portion 66, the distance $w_4$ could be the distance between edges 61 of the front frame at the indicated height.

Figure 5C:
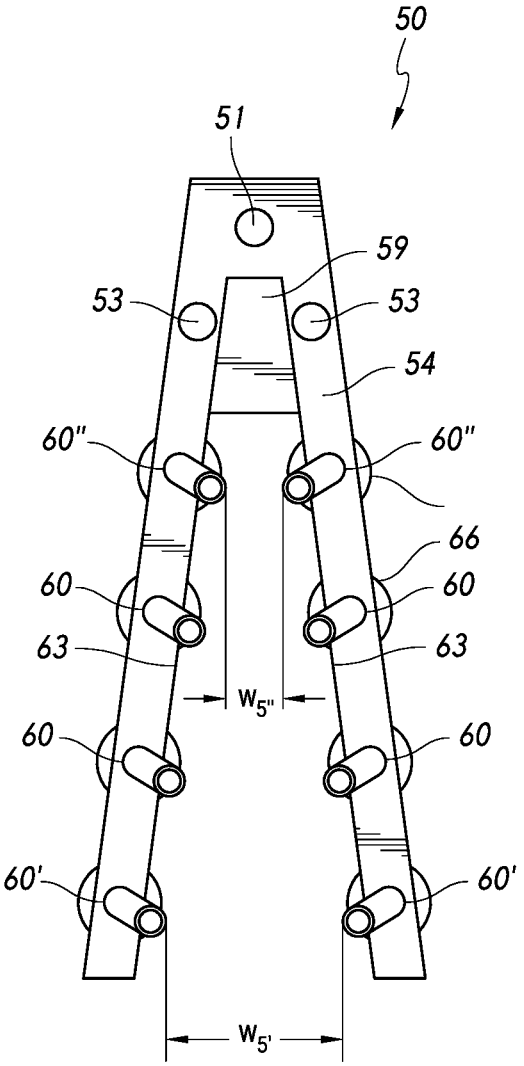
FIG. 5C is a back view of the tube feeder of FIG. 5B.

For a cage or other insert to be able to fit through the tube feeder 50, the cage or insert must be able to pass through the back of the tube feeder as well. FIG. 5C illustrates a back view of the tube feeder. Generally, the tubes will extend far enough from the frame 54 such that their angle causes them to pass within the inner edges 63 of the back frame 54. Thus, as above, to ensure that a cage can pass through the tube feeder, such as a cage with reinforcing bars 79' configured to align with bars 70' that pass through tubes 60', the width $w_{5'}$ can be greater than or equal to the width $w_{2'}$ and/or $w_{3'}$. Similarly, $w_{5''}$ can be greater than or equal to the width $w_{2''}$ and/or $w_{3''}$. In some embodiments, the tubes 60 may not extend medially past the inner edge 63 of the back frame 54. In such embodiments, the narrowest distance $w_5$ of the feeder opening 58 at the back of the tube feeder can be the distance between edges 63 of the back frame 54 at a particular height.

Figure 6A:
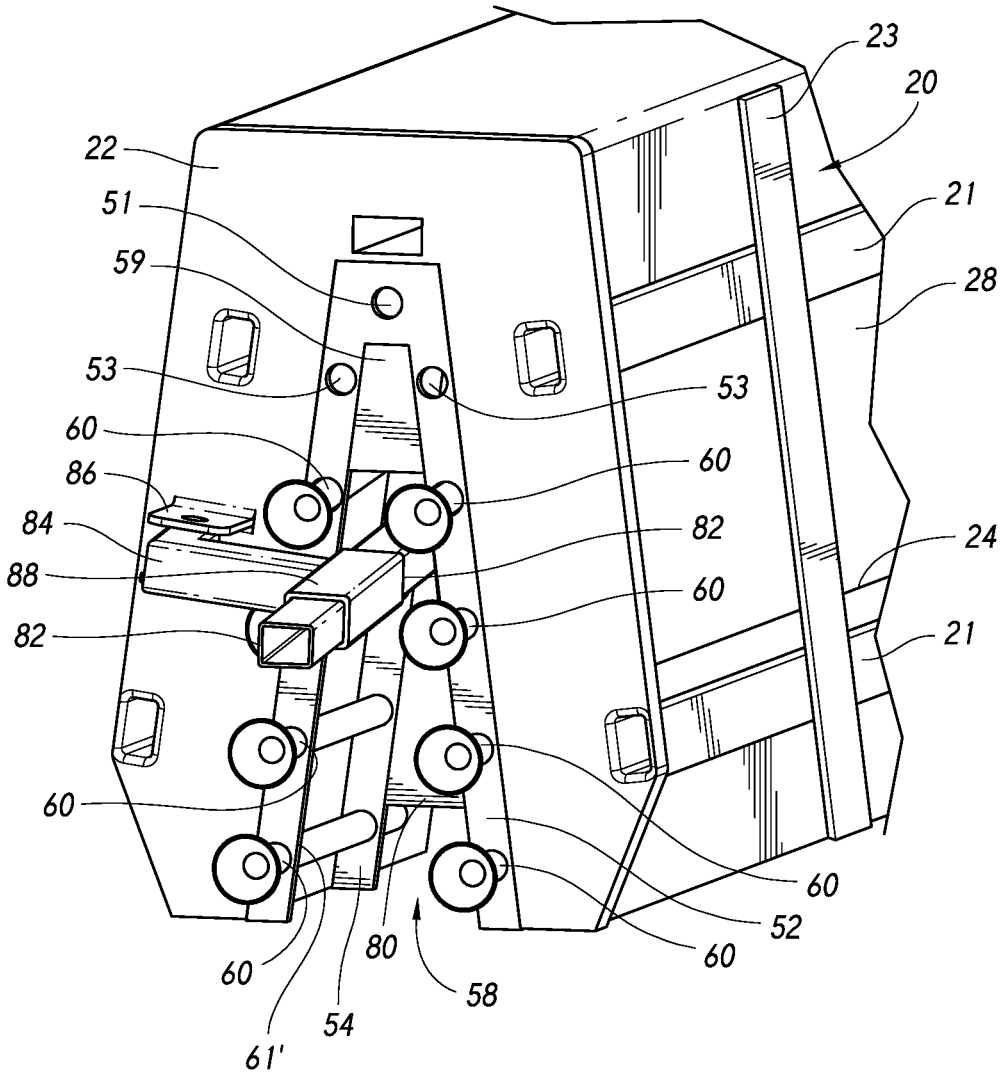
FIG. 6A is a front perspective view of one embodiment of a slip form construction system with a plunger in a first closed position.

FIG. 6A illustrates a front perspective view of a portion of a slip form concrete molding system with a tube feeder configured to allow for the continuous slip form construction of a barrier that includes reinforcing cages. In some embodiments, as illustrated, the tube feeder can include four lateral pairs of tubes 60, the tubes of each pair positioned approximately the same distance from the bottom of the tube feeder.

In some embodiments, a tube feeder can be adapted for use with more tubes and can include additional tube passages 53 that can receive tubes. In some embodiments, the top of a tube feeder can include a pinnacle tube passage 51 that can receive a non-paired tube.

In some embodiments, where the barrier being formed requires fewer reinforcing rod pairs than the particular tube feeder has tubes or has space for tubes (e.g., if a barrier will be below the maximum barrier height that the slip form concrete molding system 10 can make), a removable feeder plug 59 can be inserted into the feeder in order to fill in the space between unused tubes 60 or tube passages 53.

In some embodiments, in addition to or instead of a feeder plug 59, a slip form system can include a plunger 82 that can be used to removably position a plunger plate 80 within the tube feeder. The plunger plate can have a first closed position, as illustrated in FIG. 6A, in which the plunger plate blocks a feeder opening 58 at the back frame 54 and acts as a front wall or part of the front wall of the hopper. The plunger plate 80 in the first closed position can help contain the concrete within the hopper and/or can help maintain a head pressure of concrete to help ensure that the concrete passes as desired into the mold. In some embodiments, the plunger 82 can pass through a collar 88, which can attach to an arm 84 that attaches via a hinge mechanism 86 to a front 22 of the slip form system.

Figure 6B:
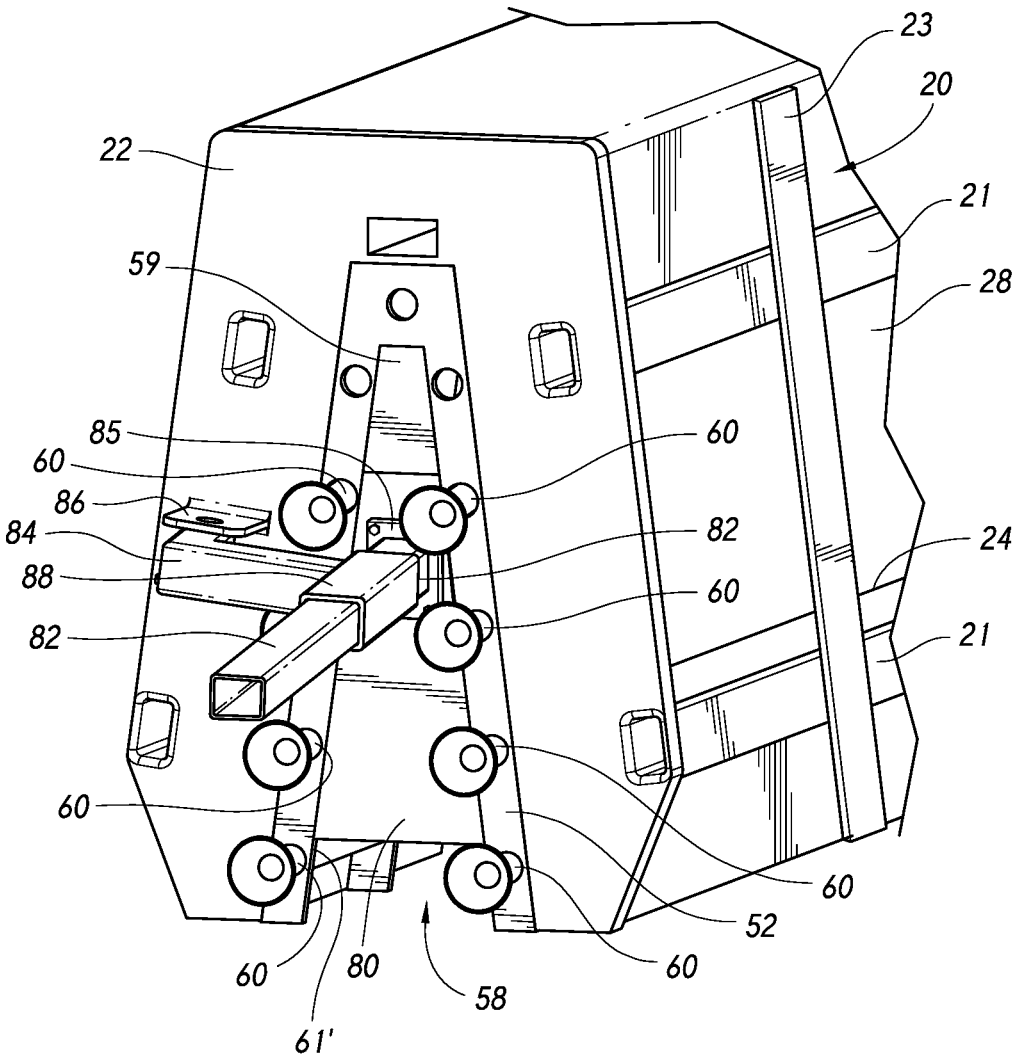
FIG. 6B is a front perspective view of the slip form construction system of FIG. 6A with the plunger in a second closed position

In some embodiments, the plunger plate 80 can be configured to move from the first closed position, in which it blocks all or a portion of a feeder opening 58 at the back frame 54, to an open position in which it blocks less or none of the feeder opening 58. In some embodiments, the plunger plate can transition from the first closed position to the open position by passing through a second closed position. FIG. 6B illustrates the plunger plate 80 in the second closed position, in which the plunger 82 has drawn the plunger plate forward until it is approximately even with the first frame 52. The plunger 82 can be actuated by a hydraulic driver, a pneumatic driver, a screw driver, or other driving mechanisms.

Figure 6C:
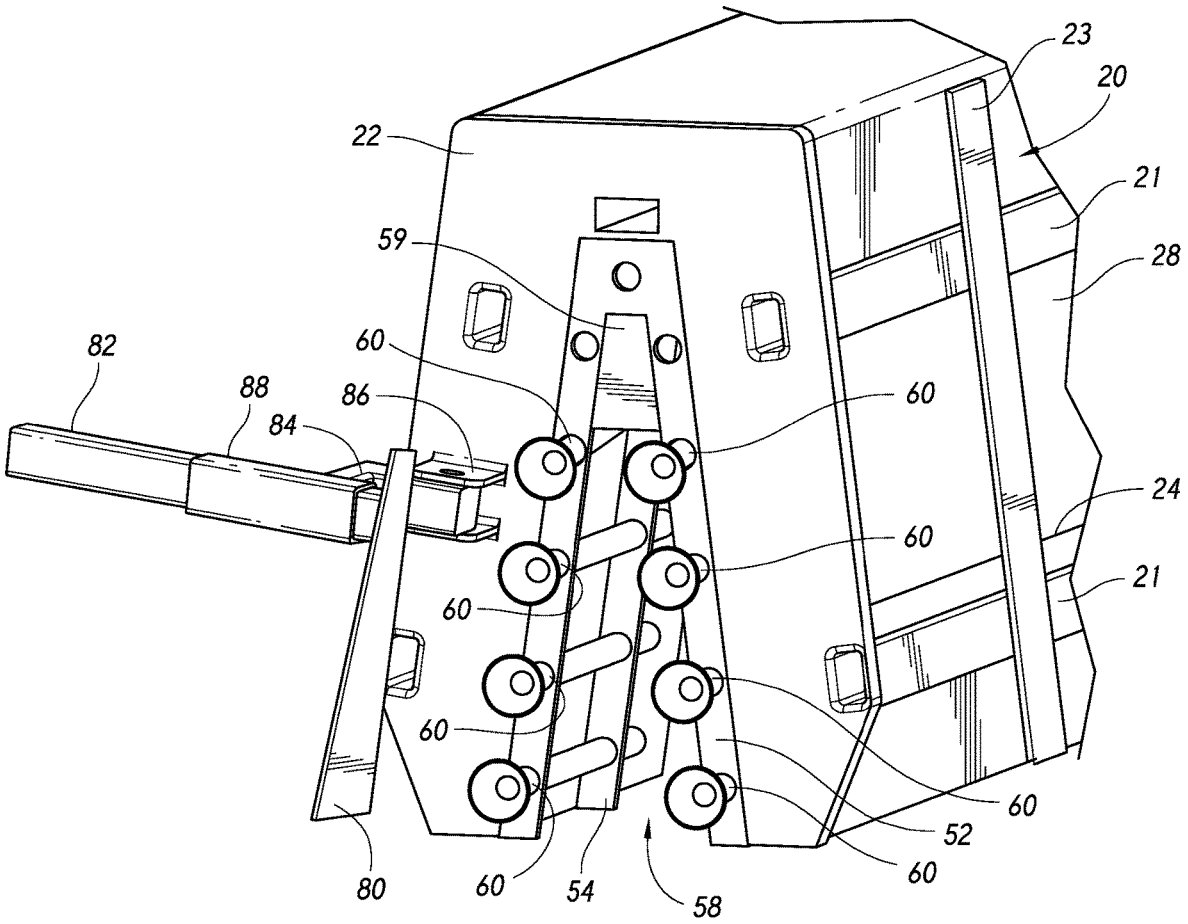
FIG. 6C is a front perspective view of the slip form construction system of FIG. 6 with the plunger in an open position.

From the second closed position, or from a position further removed from the first frame 52, in some embodiments the plunger plate 80 can rotate to the open position. FIG. 6C illustrates the plunger plate in the open position. The arm 84 can be rotated about the hinge 86 in order to rotate the plunger plate. In some embodiments, in order to prevent the plunger plate 80 from interfering with the tubes 60 as it moves from the second closed to the open position, it can be desirable for the plunger plate to rotate in the same plane as the plane in which tubes on the side of the front frame 52 closest to the hinge are aligned. Thus, for example, in some embodiments the arm 84 can be positioned perpendicular to inner edge 61' of the front frame 52 that is closest to the rod, as illustrated. In some embodiments, the plate 80 can be moved to an open position according to other methods. For example, in some embodiments it can be vertically moved out of the way or can be rotated internally and not longitudinally displaced. In some embodiments, the motion of the plate 80 can be manually driven, hydraulically driven, or driven by screws. Drive systems for both longitudinal movement and/or rotation can be coupled to the drive system of the system. Thus, the mold can be incorporated into an existing slip form molding system with minimal modifications or extra equipment.

Preferably, the plunger plate 80 can be removably connected to the plunger 82 such that plunger plates of varying sizes can be positioned, as desired, into the feeder opening 58. Thus, for example, where a feeder plug 59 is not used, a taller plunger plate 80 can be used. In some embodiments, it can be desirable to have a plunger plate 80 that can be configured to block all or a portion of the feeder opening 58 when cages are not required to be inserted through the opening or other obstacles are not in the way. In some embodiments, it can be desirable to have at least a portion of the feeder opening 58 below the plunger open to allow for the slip form system to pass over lower obstacles, such as dowels on a bridge deck. In some embodiments, the plunger 82 can include an attachment plate 85 that can be used to attach the plunger to the plunger plate 80.

FIG. 6C illustrates an embodiment with the plunger in an open position in which the plunger no longer blocks the feeder opening 58. When the slip form system reaches a location where a cage is required to be inserted within a barrier that the molding system is creating, the plunger 80 can be moved to the open position. The cage can pass through the feeder opening, from where it can pass through the hopper and mold and into the formed barrier.

FIGS. 6A-6C also illustrate a side wall 28 of the slip form concrete molding system. In some embodiments, the side wall can comprise two panels overlapping at a connection point 24. In some embodiments, the side wall can include longitudinal supports 21 and/or vertical supports 23. In some embodiments, one of the panels can move relative to the other panel to adjust a height of the molding system, such as when passing over uneven ground. In embodiments where necessary angulation of the tubes 60 requires cutting into the front plate 22, this can be done without affecting the side wall 28 or the ability of the side wall panels to slide relative to each other.

Figure 7A:
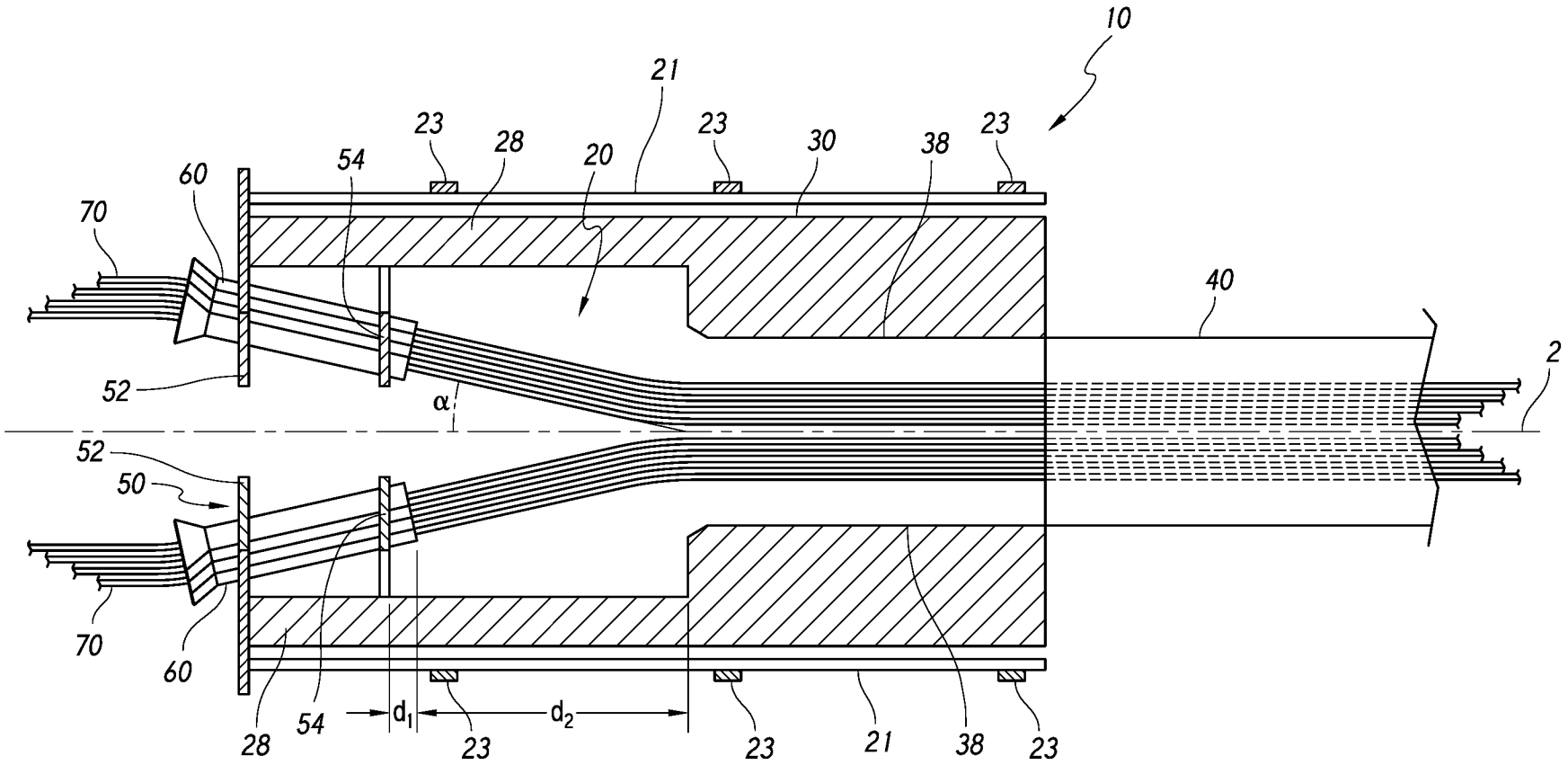
FIG. 7A is a top cross-sectional view of the slip form construction system of FIG. 1.

FIG. 7A illustrates a top cross sectional view of one embodiment of a slip form concrete molding system 10 that is configured to allow both for feeding of reinforcing bars into the slip form system while also providing the option to pass a slip form system over a cage, thereby allowing the continuous production of a barrier that includes reinforcement cages or other structures that may be required (e.g., upwardly projecting dowels). As illustrated, the slip form system 10 can include a tube feeder 50 that includes tubes 60 provided at an angle $\alpha$ relative to a longitudinal axis 2 of the system 10. As described above, this can create space for objects, such as cages, that will be positioned within a barrier produced by the system to pass directly through the tube feeder, through the interior walls 38 of the mold 30, and into the concrete barrier. This allows for the continuous motion of the system 10.

When the tubes are at an angle, the bars 70 enter the hopper at the same angle as the tubes. As the bars extend from their respective tubes, however, the force of the concrete will tend to bend the bars into alignment with the direction of motion of concrete (i.e., backward, through the hopper 20 and mold 30, and generally parallel to the longitudinal axis 2). Preferably, the bars will be aligned with the direction of motion of the concrete by the point where the bars reach the mold 30. In some embodiments, as illustrated, the bars can be aligned with the direction of motion before they reach the mold 30. In some embodiments, they can reach alignment at the mold 30. In some embodiments, the bars may not align with the direction of motion of the concrete until they are within the mold.

The tubes 60 can be positioned at generally any angle required to provide an opening of required size through the tube feeder. In some embodiments, the bars can have an angle $\alpha$ between approximately 5 degrees and approximately 45 degrees. In some embodiments, the bars can have an angle $\alpha$ between approximately 5 degrees and approximately 30 degrees. In some embodiments, the bars can have an angle $\alpha$ between approximately 5 degrees and approximately 20 degrees. In some embodiments, the bars can have an angle $\alpha$ between approximately 10 degrees and approximately 20 degrees.

In some embodiments, providing wider angles can require modifying the front plate 22 of the system (shown, for example, in FIGS. 6A through 6C) to cut out space for the tubes. Generally, the greater the angle of the tube, the greater the distance required for the bar to bend back into alignment with the direction of motion of the concrete. Thus, for example, depending on the angle of the tube it may be desirable to adjust the distance available for the bars to bend. In some embodiments, where it is preferred for the tubes to be in alignment with the direction of motion of the concrete when the tubes reach the mold, increasing the angle of the tubes may require shortening the distance $d_1$ that the tubes pass into the hopper. This will increase the distance $d_2$ between the end of the tubes and the mold 30, thereby providing more space for the bars to bend back into alignment with the direction of motion of the concrete. The length of the tubes and their angle can be varied as required to produce the particular desired geometry. Additionally, in some embodiments, one or more of the tubes can be at a different angle $\alpha$ and/or pass a different distance $d_1$ into the hopper than other tubes.

Figure 7B:
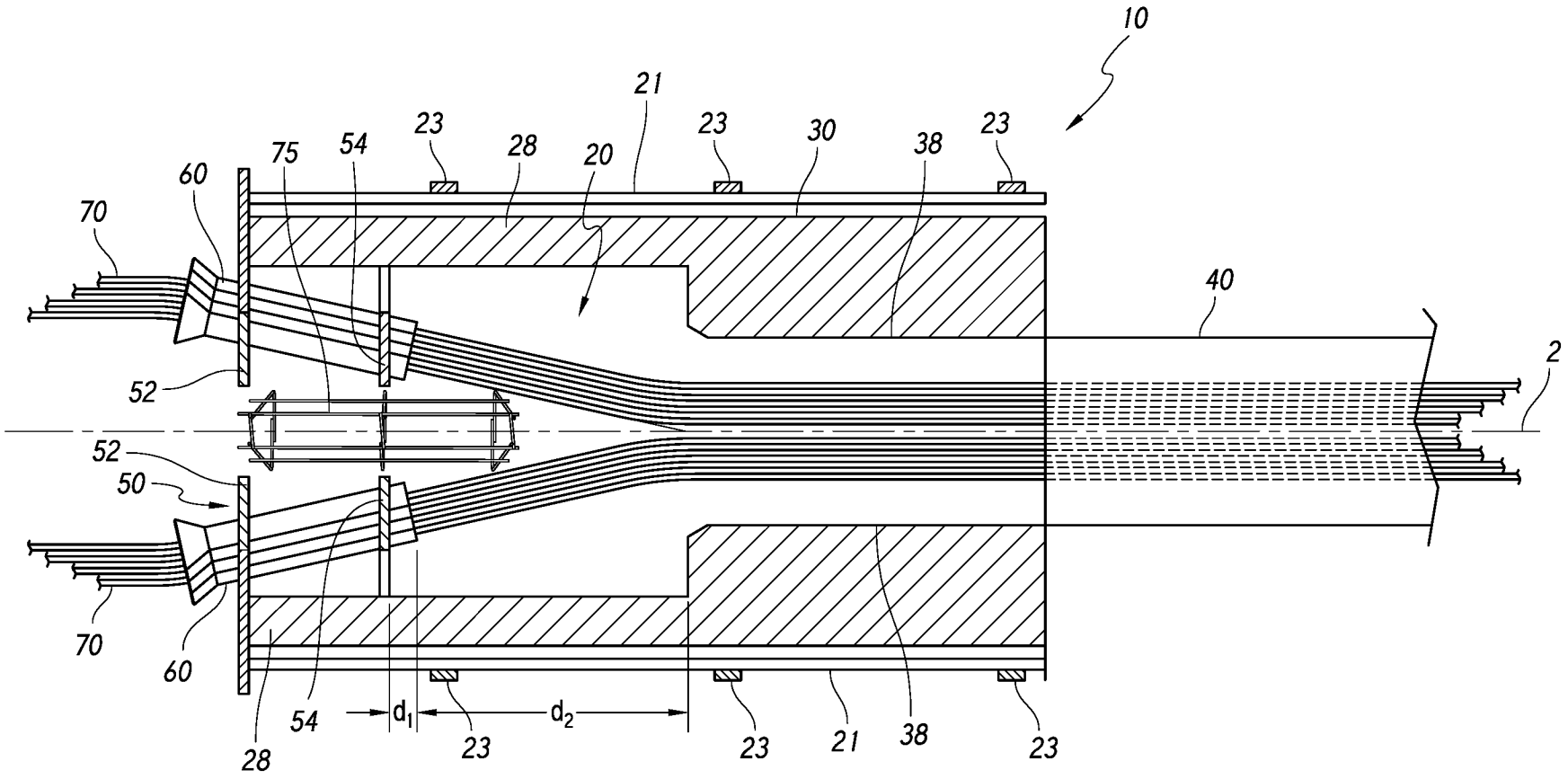
FIG. 7B is a top cross-sectional view of the slip form construction system of FIG. 7A with a cage inserted into the system.

FIG. 7B illustrates a top cross sectional view of the embodiment of FIG. 7A with a cage 75 inserted into the slip form concrete molding system. As illustrated, and according to various embodiments described herein, the cage 75 can pass through the tube feeder 50 without interference. Thus, the cage can pass through the hopper 20, through the mold 30, and be formed as part of the concrete barrier 40. The cage 75 is illustrated as passing through the slip form system while bars 70 are also passing through. In some embodiments, the bars can be cut before insertion of the cage and new bars can be inserted once the cage has passed through. In some embodiments, bars 70 that are aligned with bars 79 of a cage can be cut and tied or otherwise connected to the corresponding bar 79 on either sides of the cage to create a continuous length of longitudinal bar.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or sub-combinations of the specific features and aspects of the embodiments may be made and still fall within the scope of the invention. Accordingly, it should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above, but should be determined only by a fair reading of the claims that follow.

Similarly, this method of disclosure is not to be interpreted as reflecting an intention that any claim require more features than are expressly recited in that claim. Rather, as the following claims reflect, inventive aspects lie in a combination of fewer than all features of any single foregoing disclosed embodiment. Thus, the claims following the Detailed Description are hereby expressly incorporated into this Detailed Description, with each claim standing on its own as a separate embodiment.

The terms "approximately", "about", and "substantially" as used herein represent an amount close to the stated amount that still performs a desired function or achieves a desired result. For example, the terms "approximately", "about", and "substantially" may refer to an amount that is within less than 10% of, within less than 5% of, within less than 1% of, within less than 0.1% of, and within less than 0.01% of the stated amount.

What is claimed is:

1. A system for the slip-form construction of a concrete barrier, said system comprising:

a mold having a front end and a back end connected by a central axis, the mold configured to receive concrete at the front end and shape the concrete into the form of a molded concrete barrier to exit the mold at the back end;

a hopper connected to the mold, the hopper having a front end and a back end connected by the central axis, the hopper configured to receive concrete and provide concrete to the mold; and a tube feeder comprising a frame defining a longitudinal opening and a plurality of tubes passing through the frame, each tube configured to receive a reinforcing bar at a front end of the tube and to direct the reinforcing bar out of the tube at a back end of the tube and into the hopper to thereby extend through the hopper and mold and into the molded concrete barrier, wherein the plurality of tubes comprises at least a first pair of tubes positioned at approximately the same height from a bottom of the tube feeder;

wherein the tubes of the first pair of tubes are angled relative to the central axis such that the shortest distance between the two tubes is greater at the front of the tube feeder than the back of the tube feeder.

2. The system for the slip-form construction of a concrete barrier of claim 1, wherein the frame comprises a front frame and a back frame joined by the plurality of tubes.

3. The system for the slip-form construction of a concrete barrier of claim 1, further comprising a plurality of pairs of tubes, wherein the tubes of each pair are the same distance from the bottom of the tube feeder.

4. The system for the slip-form construction of a concrete barrier of claim 3, wherein the first pair of tubes is closer to the bottom of the tube feeder than any other pair of tubes.

5. The system for the slip-form construction of a concrete barrier of claim 3, further comprising a pinnacle tube that is farther from the bottom of the tube feeder than any other tube.

6. The system for the slip-form construction of a concrete barrier of claim 1, further comprising a second pair of tubes, wherein each tube of the second pair of tubes is the same distance from the bottom of the tube feeder, the second pair of tubes being farther from the bottom of the tube feeder than any other pair of tubes.

7. The system for the slip-form construction of a concrete barrier of claim 6, wherein the second pair of tubes are angled relative to the longitudinal axis such that the distance between the two tubes at the back of the tube feeder is less than the distance between the two tubes at the front of the tube feeder.

8. The system for the slip-form construction of a concrete barrier of claim 1, further comprising a plate member configured to selectively occlude at least a portion of the opening in the frame.

9. The system for the slip-form construction of a concrete barrier of claim 8, wherein the plate is movable away from the opening to permit unrestricted passage through the portion of the opening that the plate is configured to occlude.

10. A system for the slip-form construction of a concrete barrier, said system comprising:

a mold having a front end and a back end connected by a central axis, the mold configured to receive concrete at the front end and shape the concrete into the form of a molded concrete barrier to exit the mold at the back end;

a hopper connected to the mold, the hopper having a front end and a back end connected by the central axis, the hopper configured to receive concrete and provide concrete to the mold; and a tube feeder comprising a frame defining a longitudinal opening and a plurality of tubes passing through the frame, each tube configured to receive a reinforcing bar at a front end of the tube and to direct the reinforcing bar out of the tube at a back end of the tube and into the hopper to thereby extend through the hopper and mold and into the molded concrete barrier, wherein the plurality of tubes comprises at least a first pair of tubes approximately the same height from a bottom of the tube feeder and wherein the reinforcing bars passing through the tubes of the first pair of tubes are configured to be a first defined distance apart when the reinforcing bars are within the molded concrete barrier;

wherein the width of the longitudinal opening at the height of the first pair of tubes is at least as wide as the first defined distance that the reinforcing bars passing through the first pair of tubes are apart when the reinforcing bars are within the molded concrete barrier; and wherein the longitudinal opening extends from a first height to a second height, a narrowest distance of the longitudinal opening at the first height being greater than the distance between the reinforcing bars passing through the tubes of the first pair of tubes when the reinforcing bars are in the concrete construction.

11. The system of claim 10, wherein the narrowest distance of the longitudinal opening at the first height is defined by the frame.

12. The system of claim 10, wherein the tubes of the first pair are in a horizontal plane.

13. The system of claim 10, further comprising a second pair of tubes passing through the frame, each tube of the second pair at approximately a second height from the bottom and configured to receive a reinforcing bar at a front end of the tube and to direct the reinforcing bar out of the tube at a back end of the tube.

14. The system of claim 10, further comprising a plate member configured to selectively occlude at least a portion of the longitudinal opening in the frame.

* * * * *